US006539648B1

(12) United States Patent
Collavo

(10) Patent No.: US 6,539,648 B1
(45) **Date of Patent: *Apr. 1, 2003**

(54) BOOT FOR SPORT INVOLVING SLIDING MOTION

(75) Inventor: Andrea Collavo, Montebelluna/TV (IT)

(73) Assignee: Lange International S.A., Fribourg (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/263,342

(22) Filed: Mar. 5, 1999

(30) Foreign Application Priority Data

Mar. 12, 1998 (CH) ..... 0593/98

(51) Int. Cl.[7] ..... A43B 5/04; A43B 5/16

(52) U.S. Cl. ..... 36/117.1; 36/115; 36/119.1; 36/3 A

(58) Field of Search ..... 36/115, 117.1, 36/117.2, 117.9, 118.2, 118.9, 119.1, 106, 3 R, 3 A

(56) References Cited

U.S. PATENT DOCUMENTS

| | | | | | |
|---|---|---|---|---|---|
| 3,972,134 | A | * | 8/1976 | Kastinger | |
| 4,085,528 | A | * | 4/1978 | Delery | 36/121 |
| 5,171,033 | A | * | 12/1992 | Olson et al. | 36/3 R |
| 5,410,822 | A | * | 5/1995 | Vaccari | 36/117.1 |
| 5,411,278 | A | * | 5/1995 | Wittmann | 36/115 |
| 5,446,976 | A | * | 9/1995 | Donnadieu et al. | 36/117.1 |
| 5,505,011 | A | * | 4/1996 | Bleimhofer | 36/3 A |
| 5,570,522 | A | * | 11/1996 | Olson et al. | 36/115 |
| 5,678,833 | A | * | 10/1997 | Olson et al. | 36/115 |
| 5,718,067 | A | * | 2/1998 | Ostinet et al. | 36/117.1 |
| 5,752,331 | A | * | 5/1998 | Perrissoud et al. | 36/117.1 |
| 5,772,220 | A | * | 6/1998 | Gaster | 36/115 |
| 5,878,513 | A | * | 3/1999 | Annovi et al. | 36/115 |
| 5,909,885 | A | * | 6/1999 | Borel | 36/115 |
| 5,913,526 | A | * | 6/1999 | Olson et al. | 36/115 |

FOREIGN PATENT DOCUMENTS

| | | | | |
|---|---|---|---|---|
| DE | 2005900 A1 | | 9/1970 | |
| DE | 4200547 | * | 7/1992 | 36/45 |
| EP | 317798 | * | 5/1989 | 36/117.1 |
| EP | 0634115 A1 | | 1/1995 | |
| EP | 0645101 A1 | | 3/1995 | |
| EP | 0761113 A1 | | 3/1997 | |
| FR | 2077184 A1 | | 10/1971 | |
| WO | WO 9727772 A1 | | 8/1997 | |
| WO | WO 9735494 A1 | | 10/1997 | |

OTHER PUBLICATIONS

International Search Report in SN 31384 CH—SUISSE.

* cited by examiner

*Primary Examiner*—Anthony D. Stashick
(74) *Attorney, Agent, or Firm*—Bugnion S.A.; John Moetteli

(57) ABSTRACT

A boot is constituted, on the one hand, of a shell (1), a cuff (2) joined to the shell, the shell and the cuff presenting zones of differing rigidity **(18, 19*a*, 27, 28). The zones of lesser rigidity (14, 16, 18) of the shell permitting the support, on the sides of the shell, of a rigid heel zone (5) extending toward the front by a lateral oblique band (10) carrying the buckles (11, 12). The rigid zone of the cuff comprises two lateral flaps (19) and at least a collar (20) wherein the rearward portion of the collar is connected to the heel by a joining component (24)** regulating the flexing and the rear support. The surface of the rigid zones is minimal.

9 Claims, 2 Drawing Sheets

BOOT FOR SPORT INVOLVING SLIDING MOTION

BACKGROUND OF THE INVENTION

The invention concerns a boot for a sport involving sliding motion, in particular, downhill skiing, wherein the upper is constituted, on the one hand, of a plastic shell of a variable volume closing itself over the foot and the instep by two overlapping flaps and provided with at least one closing and tightening device comprising a portion integral with the shell corresponding to the internal side of the foot and an external part of the shell integral with the opposite side, the shell presenting zones of different rigidities and, on the other hand, of a cuff joined to the shell at two opposed points in the malleolar, opening itself toward the front, provided with at least one closing and tightening device and presenting likewise the zones of different rigidities.

In boots having a rigid shell according to the prior art, during the flexing of the leg, the lower buckle of the cuff comes to press against the shell which likewise controls the flexing of the boot.

In patent FR 2 077 184, the content of which is incorporated by reference, the fabrication of ski boots having characteristics as close as possible to boots of leather and utilizing two or more plastic materials having different mechanical properties is proposed. The shell of the boot is formed by successively injecting plastic material with the introduction of reinforcing elements at predetermined points in the injected material.

The resulting shell is, in this way, a relatively supple shell providing reinforced zones for anchoring the buckles of the boot.

In the European Patent Application EP 0 645 101, the content of which is incorporated by reference, a ski boot shell presenting zones of different rigidities and different resistances is known, the more resistant and the more rigid parts constituting a type of triangular framework, wherein the role is the optimum transmission of force between the leg and the ski.

These designs have the purpose of lightening the boot without weakening the anchoring of the buckles and preserving for them a rigidity sufficient for performing its role as an interface between the foot and the ski.

If one considers only the shell and the cuff, the limit for lightening of the shell and the cuff together has been attained if one desires that the boot preserve the flexural characteristics and sufficient rear support.

The invention has the purpose of going beyond these limits by taking into consideration the assembly of the boot, that is to say the shell and its cuff generally referred to as the collar.

The boot according to the present invention is characterized in that the sides of the shell present zones of lesser rigidity permitting the support, on the two sides of the shell, of a rigid heel zone extending toward the front by a lateral oblique band extending at least to the tightening device situated the most forward in such as manner as to carry the tightening device, in that the cuff presents a zone of highest rigidity comprising two lateral flanges/sides, by which the cuff is articulated on which the lateral bands of the shell, and at least a collar connected to the flanges/sides and having a closing device and a tightening device, and in that the rearward portion of the collar is connected to the shell's heel zone by a joining component resistant to tension and/or compression, of such a type that the oblique band, the collar, and the joining component form a skeleton assuring the kinematics of the boot.

For kinematics, one expects, in particular, the control of the flexing of the boot.

The skeleton fulfills all the mechanical conditions necessary for skiing and it may be reduced to a minimum, watertightness being assured by the portion having the lesser rigidity therefore the thickness may be reduced because this part does not have a mechanical function. The weight of the boot will find itself, consequently, further reduced.

In other words, as opposed to traditional boots which form a whole and react globally, the boot according to the invention have been totally restructured such that each part plays a very precise role: the supple, lesser rigid portion assures watertightness, the rigid part constitutes a skeleton and the joining component which control the of the rear support.

The joining component between the collar and the shell may be a rigid bar or an elastic joint in tension permitting a flexing of the cuff towards the front in a manner to follow the flexing of the leg or also an elastic connection in tension and compression in a manner to likewise absorb the shocks toward the rearward portion.

The joining component may be equally made of a releasing device such as a toggle joint described in patent application WO PCT/US 20203, the content of which is incorporated by reference, having the purpose of protecting the rear crossing ligament.

The shell and the collar is advantageously provided with a process of bi-injection consisting of the successive injecting plastic materials of different rigidity in the same mold or in two successive molds.

BRIEF DESCRIPTION OF THE DRAWINGS

The attached drawings represent, by way of example, an embodiment of a ski boot according to the invention.

DETAILED DESCRIPTION OF THE PREFERRED EMBODIMENT(S)

Figure 1:
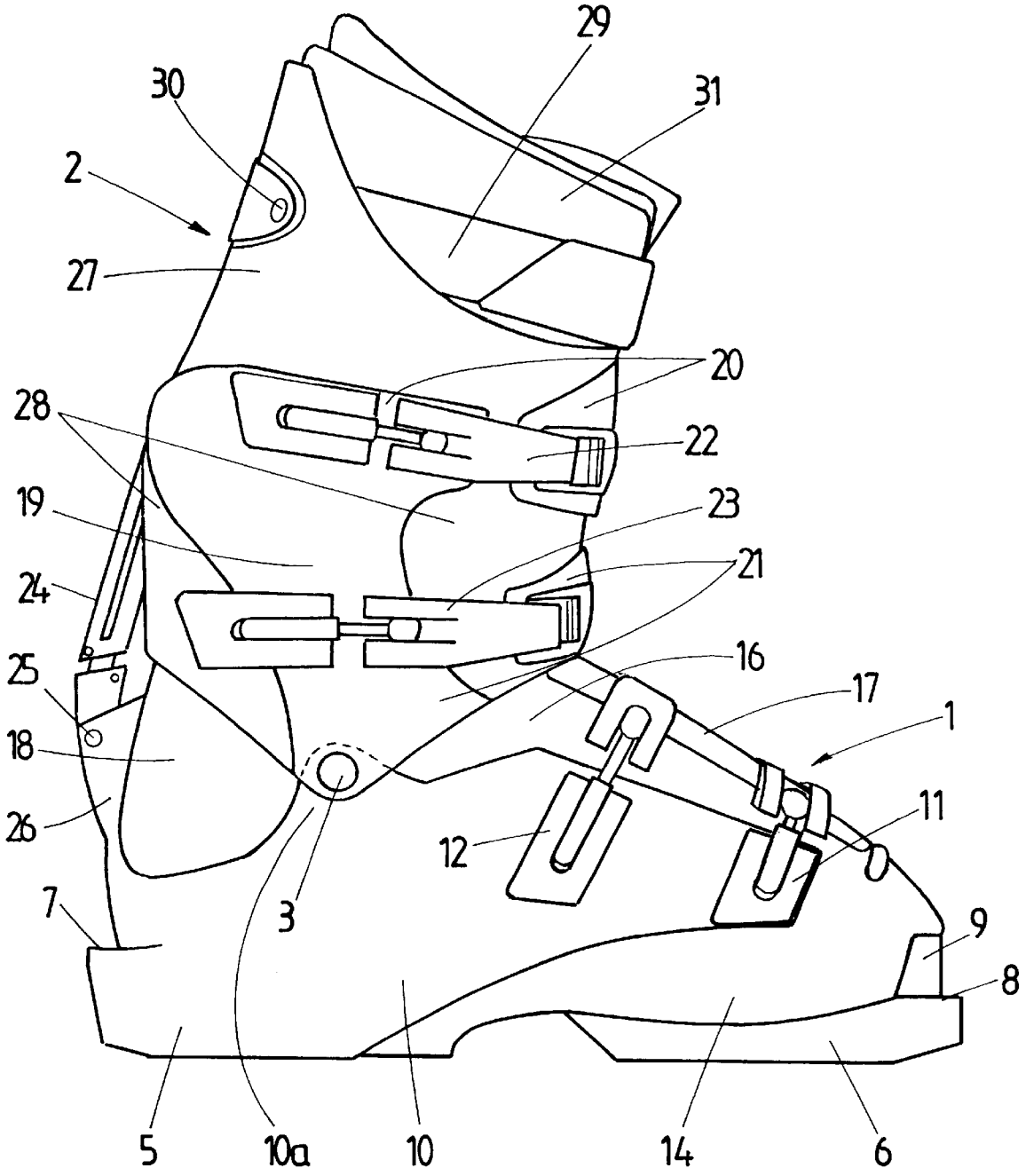
FIG. 1 is a lateral view of the boot, showing an external side of the foot.
Figure 2:
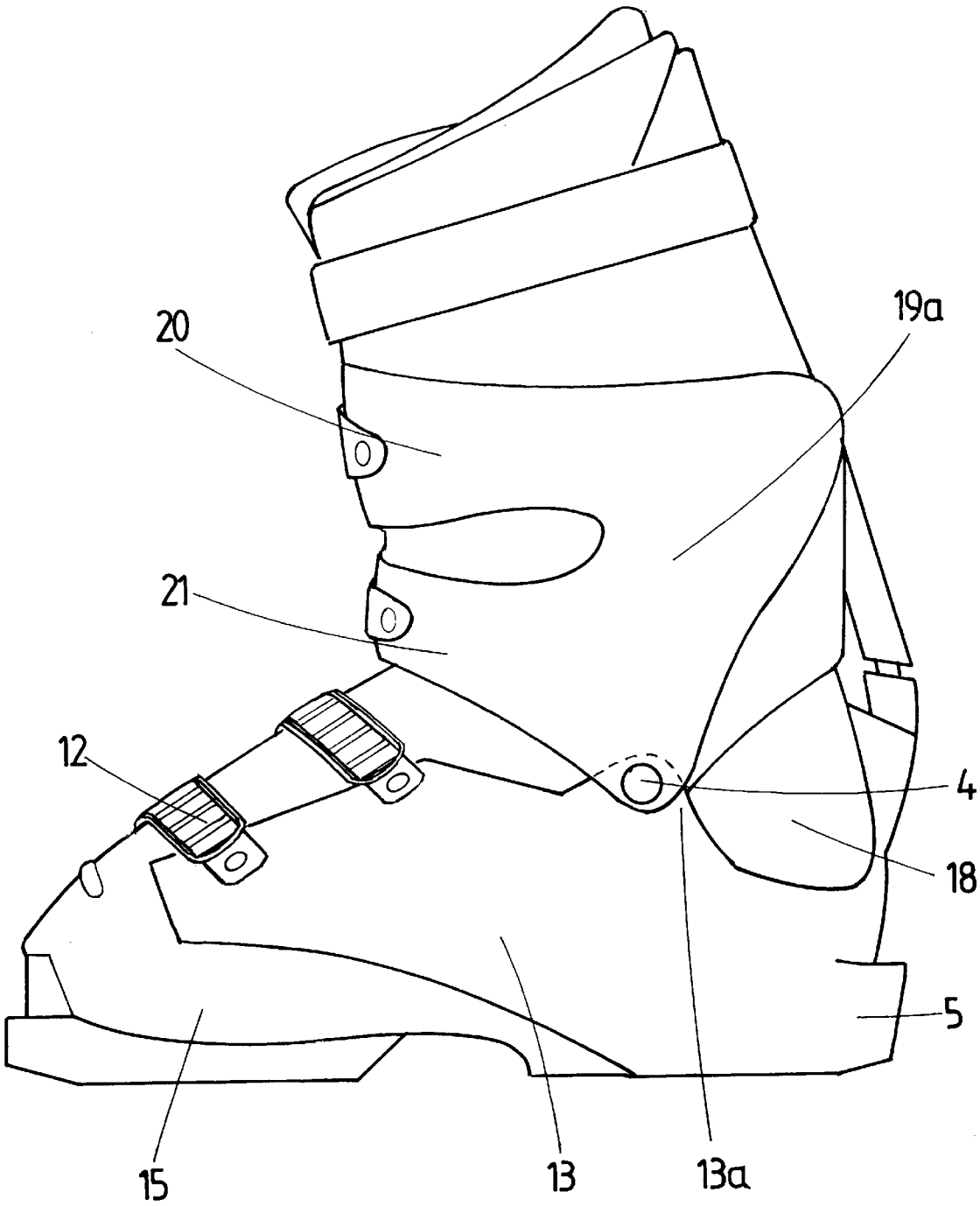
FIG. 2 is the same boot showing the internal side of the foot.

The ski boots represented are constituted of a shell 1 of a variable volume and of a cuff 2 rotatably joined to the shell 1 at two opposed points 3 and 4 situated in the malleolar region. The shell 1 is provided with two buckles 11 and 12 and the cuff 2 with two buckles 22 and 23.

The shell 1 of variable volume is made of two plastic materials of different rigidity. The more rigid zones are first the heel zone 5 and the front sole area 6. The heel zone 5 presents a rear bearing surface 7 for the support of a rear binding element, whereas the front sole area 6 presents a front bearing surface for the support of a front binding element and a vertical portion 9 likewise for receiving the frontal support of a jaw of a front binding. The heel zone is extended, of the external side of the shell, by a band 10 extending obliquely to the front to the buckle 11 situated at the extreme forward position with respect to the shell in such a manner that the footing of the adjustment lever of the buckle 11 is fixed to the more rigid zone 10. The band 10 may be extended further in a manner to arrive on the end of the foot. The footing of the adjustment lever of the buckle 12 is of course equally fixed to the zone 10.

Of the internal side of the shell, the heel zone is equally extended by a more rigid band 13 which extends equally obliquely to the front of a distance such that the locking teeth of the buckles 11 and 12 are fixed on the band 13.

The remainder of the shell, that is to say, the metatarsal phalangeal 14 and 15 extending from each side of the shell from the front until under the sole of the foot, under the bands 10 and 13; the flaps 16 and 17 and the posterior zone 18 extending on top of the heel, around the Achilles tendon, are constituted of a plastic having a lesser rigidity.

The cuff 2 is likewise constructed of two materials of different rigidity 19 and 19*a* (of higher rigidity), and 27 an 28 (of lesser rigidity). The more rigid zone 19 and 19*a* forms two flanges/sides by which the cuff 2 is rotatably joined at 3 and 4 on the lateral excrescence 10*a* and 13*a* of band 10 and 13 of the shell 1 and two collars 20 and 21 situated one above the other. The collar 20 supports the first buckle 22 and the collar 21 the second buckle 23, buckles that permit the closing and tightening of the collar and consequently of the cuff 2 around the leg.

The collars 20 and 21 are connected to the shell 1 by adjoining component 24, thus the lower extremity is joined at a point 25 on the extension 26 of the heel zone 5 of the shell toward the top. In the embodiment shown, the joining component 24 is a component presenting an elasticity in compression and tension, but presenting a limited resistance to compression, and releasing toward the rear during an overload, such as that described in patent WO PCT/US 20203, the content of which is incorporated by reference.

The remainder of the cuff 2, in particular the zone 27 and 28, situated respectively over and under the collar 20, is of a plastic material having lesser rigidity.

In the drawing, one can see among other things a strap 29 fixed to the interior of the back of the upper portion of the cuff 2 by the rivets 30 and serving, in a known manner, to provide tibial support to a comfort slipper.

From each side of the boot, the band 10 and 13, respectively, the collars 20 and 21 and the joining component 24 forms in this way a triangular system wherein the rigidity assures good guidance of the ski and a perfect anchoring of the buckles. The surface of the rigid zones is minimal.

In that it concerns the joining component 24, it should be constituted of a simple rigid bar or of a joint comprising a tension spring or a spring in tension and compression.

The zones of lesser rigidity may be constituted of an impermeable tissue, in particular of a tissue having micropores.

The structure according to the invention is applicable to all shoes for sliding sports, such as skiing and snowboarding.

Although illustrative embodiments of the invention have been shown and described, a wide range of modification, change, and substitution is contemplated in the foregoing disclosure and in some instances, some features of the present invention may be employed without a corresponding use of the other features. Accordingly, it is appropriate that the appended claims be construed broadly and in a manner consistent with the scope of the invention.

I claim:

1. A ski boot Shaving an upper, a front, and an instep, wherein the upper comprises:

a shell (1) having sides made in plastic material of a variable volume, the shell closing over the foot and the instep by two overlapping flaps (16, 17) and provided with at least one device for closing and tightening (11, 12) comprising a portion integral with the shell corresponding to an internal side of the foot and a portion integral to the opposite side, external to the shell, the shell presenting zones (14, 16, 18) of different rigidities; and a cuff (2) rotatably joined to the shell at two opposed points (3, 4) in the malleolar region, opening toward the front, provided with at least a closing and tightening device (22, 23) and presenting likewise zones made of materials of differing rigidity (19, 19*a*, 27, 28) including at least a more rigid zone and a lesser rigid zone, wherein the sides of the shell (1) are made of a less rigid material permitting the support, on the sides of the shell, by a rigid heel zone (5) extending toward the front by a lateral oblique band (10, 13) at least to a tightening device (11) situated the most forward and which supports the tightening device (11), in that the cuff (2) presents a more rigid zone comprising two lateral flaps (19, 19*a*), by which the cuff is rotatably joined on the lateral bands of the shell, and to at least a collar (20, 21) having a rearward portion, and being connected to the flaps (19, 19*a*) and carrying the closing and tightening device (22), and in that the rearward portion of the collar is connected to the heel zone (5) of the shell by a joining component (24) having a rearward portion that resists tension and compression, wherein further, on each side of the boot, the oblique band (10, 13), the collar (20) and the joining component (24) form a rigid triangular framework assuring the kinematics of the boot.

2. The boot according to claim 1, characterized in that the more rigid zone of the cuff (2) comprises a second collar (21) including the said flaps.

3. The boot according to claim 1, characterized in that the joining component (24) between the cuff and the shell is comprised of a rigid bar.

4. The boot according to claim 1, characterized in that the joining component (24) between the cuff and the shell is elastic.

5. The boot according to claim 1, characterized in that the joining component (24) between the cuff and the shell is a device offering limited resistance to compression.

6. The boot according to claim 5, characterized in that the joining component (24) is releasable toward the rearward portion.

7. The boot according to claim 1, characterized in that the surface of the rigid zone is minimal.

8. The boot according to claim 1, characterized in that the less rigid zone is constituted of an impermeable material.

9. The boot according to claim 8, characterized in that the impermeable material is micro porous.

* * * * *